US009852722B2

(12) United States Patent
Biswas

(10) Patent No.: US 9,852,722 B2
(45) Date of Patent: Dec. 26, 2017

(54) ESTIMATING A TEMPO METRIC FROM AN AUDIO BIT-STREAM

(71) Applicant: DOLBY INTERNATIONAL AB, Amsterdam Zuidoost (NL)

(72) Inventor: Arijit Biswas, Erlangen (DE)

(73) Assignee: Dolby International AB, Amsterdam Zuidoost (NL)

( * ) Notice: Subject to any disclaimer, the term of this patent is extended or adjusted under 35 U.S.C. 154(b) by 0 days.

(21) Appl. No.: 15/118,044

(22) PCT Filed: Feb. 18, 2015

(86) PCT No.: PCT/EP2015/053371
§ 371 (c)(1),
(2) Date: Aug. 10, 2016

(87) PCT Pub. No.: WO2015/124597
PCT Pub. Date: Aug. 27, 2015

(65) Prior Publication Data

US 2016/0351177 A1 Dec. 1, 2016

Related U.S. Application Data

(60) Provisional application No. 61/941,283, filed on Feb. 18, 2014.

(51) Int. Cl.
*G10H 1/40* (2006.01)
*G10H 7/00* (2006.01)
(Continued)

(52) U.S. Cl.
CPC ..... *G10H 1/0008* (2013.01); *G10H 1/40* (2013.01); *G10L 19/008* (2013.01);
(Continued)

(58) Field of Classification Search
CPC ..... G10H 1/0008; G10H 2210/076; G10L 19/167; G10L 19/008
(Continued)

(56) References Cited

U.S. PATENT DOCUMENTS 4,443,883 A * 4/1984 Berger ..... G11B 20/10 360/40
6,978,236 B1 12/2005 Liljeryd
(Continued)

FOREIGN PATENT DOCUMENTS

| | | |
|---|---|---|
| WO | 2004/038927 | 5/2004 |
| WO | 2011/051279 | 5/2011 |
| WO | 2013/090207 | 6/2013 |

OTHER PUBLICATIONS

Hollosi, D. et al "Complexity Scalable Perceptual Tempo Estimation from HE-AAC Encoded Music" AES Convention Paper 8109 presented at the 128th Convention, May 22-25, 2010, London, UK, pp. 1-15.

(Continued)

*Primary Examiner* — Jeffrey Donels

(57) ABSTRACT

The invention relates to estimating tempo information directly from a bitstream encoding audio information, preferably music. Said tempo information is derived from at least one periodicity derived from a detection of at least two onsets included in the audio information. Such onsets are detected via a detection of long to short block transitions (in the bitstream) or/and via a detection of a changing bit allocation (change of cost) regarding encoding/transmitting the exponents of transform coefficients encoded in the bitstream.

20 Claims, 4 Drawing Sheets

(51) Int. Cl.

| | |
|---|---|
| ***G10H 1/00*** | (2006.01) |
| ***G10L 19/008*** | (2013.01) |
| ***G10L 19/16*** | (2013.01) |
| ***G10L 25/03*** | (2013.01) |
| *G10L 19/022* | (2013.01) |

(52) U.S. Cl.
CPC ..... *G10L 19/167* (2013.01); *G10L 25/03* (2013.01); *G10H 2210/076* (2013.01); *G10L 19/022* (2013.01)

(58) Field of Classification Search
USPC ..... 84/611
See application file for complete search history.

(56) References Cited

U.S. PATENT DOCUMENTS 7,050,980 B2 * 5/2006 Wang ..... G10H 1/0058 381/56
7,593,618 B2 * 9/2009 Xu ..... G06F 17/30811 386/239
2009/0304204 A1 12/2009 Bieber
2012/0215546 A1 * 8/2012 Biswas ..... G10H 1/40 704/500
2012/0237039 A1 9/2012 Thesing
2013/0282388 A1 10/2013 Engdegard

OTHER PUBLICATIONS

Zhu, J. et al "Complexity-Scalable Beat Detection with MP3 Audio Bitstreams" Computer Music Journal 32:1, pp. 71-87, Spring 2008.
Wang, Y. et al "A Compressed Domain Beat Detector Using MP3 Audio Bitstreams" Proceedings of the ninth ACM International Conference on Multimedia, pp. 194-202, ACM New York, NY, 2001.
Jarina, R. et al "Rhythm Detection for Speech-Music Discrimination in MPEG Compressed Domain" IEEE 14th International Conference on Digital Signal Processing, Jul. 1-3, 2002, pp. 129-132.
Nakanishi, M. et al "A Method for Extracting a Musical Unit to Phrase Music Data in the Compressed Domain of TwinVQ Audio Compression" IEEE International Conference on Multimedia and Expo, Jul. 6, 2005, pp. 1-4.
Shao, X. et al "Automatic Music Summarization in Compressed Domain" IEEE International Conference on Acoustics, Speech, and Signal Processing, May 17-21, 2004, pp. 261-264.
Davidson, G.A. "Digital Audio Coding Dolby AC-3", Digital Signal Processing Handbook, Ed Vijaj K. Madisetti and Douglas B. Wiliams, Boca Raton CRC Press LLC, 1999.

* cited by examiner

ESTIMATING A TEMPO METRIC FROM AN AUDIO BIT-STREAM

CROSS-REFERENCE TO RELATED APPLICATIONS

This application claims the benefit of priority to U.S. Provisional Patent Application No. 61/941,283 filed 18 Feb. 2014, which is hereby incorporated by reference in its entirety.

TECHNOLOGY

Example embodiments described herein generally relates to audio signal processing and more specifically estimating a tempo metric from an audio bit-stream.

BACKGROUND

Portable handheld devices (PDAs), such as smart phones, feature phones, portable media players and the like, typically include audio and/or video rendering capabilities to provide access to a variety of entertainment content as well as support social media applications. Such PDAs employ low complexity algorithms due to their limited computational power as well as energy consumption constraints. A variety of tools may be employed by low complexity algorithms such as Music Information Retrieval (MRI) applications which cluster or classify media files. An important musical feature for various MIR applications includes genre and mood classification, music summarization, audio thumbnailing, automatic playlist generation and music recommendation systems using music similarity such as musical tempo. Accordingly, there is a need for a procedure for extracting tempo information from an audio signal from an encoded bit-stream of an audio signal,

SUMMARY OF THE INVENTION

In view of the above, the example embodiments disclosed herein provides a method for estimating a tempo metric related to an audio signal based on an encoded bit-stream representing the audio signal, wherein the bit-stream includes a plurality of audio blocks. The method includes, receiving the bit-stream, detecting transitions in block sizes of the audio blocks in the bit-stream, determining at least one periodicity related to a re-occurrence of the detected transitions and determining an estimated tempo metric based on the determined periodicity.

In another example embodiment there is an apparatus for estimating a tempo metric related to an audio signal based on an encoded bit-stream representing the audio signal, wherein the bit-stream includes a plurality of audio blocks. The apparatus includes an input unit for receiving the bit-stream and a computing unit for detecting transitions in block sizes of the audio blocks in the bit-stream, determining at least one periodicity related to a re-occurrence of the detected transitions, and determining an estimated tempo metric based on the determined periodicity.

In yet another example embodiment there is an apparatus for estimating a tempo metric related to an audio signal based on an encoded bit-stream representing the audio signal, the bit-stream encoded in a format including mantissas and exponents to represent transform coefficients. The apparatus includes an input unit for receiving the bit-stream and a computing unit for repeatedly determining a cost of encoding the exponents based on information included in metadata of the bit-stream, detecting a change of the cost, determining at least one periodicity related to a re-occurrence of the detected change of cost, and, determining an estimated tempo metric based on the determined periodicity.

In still yet another example embodiment there is a non-transitory computer-readable storage medium which stores executable computer program instructions for executing a method for estimating a tempo metric related to an audio signal based on an encoded bit-stream representing the audio signal, wherein the bit-stream includes a plurality of audio blocks. The method includes receiving the bit-stream, detecting transitions in block sizes of the audio blocks in the bit-stream, determining at least one periodicity related to a re-occurrence of the detected transitions and determining an estimated tempo metric based on the determined periodicity.

These and other example embodiments and aspects are detailed below with particularity.

The foregoing and other aspects of the example embodiments of this invention are further explained in the following Detailed Description, when read in conjunction with the attached Drawing Figures.

DESCRIPTION OF EXAMPLE EMBODIMENTS

Figure 1A:
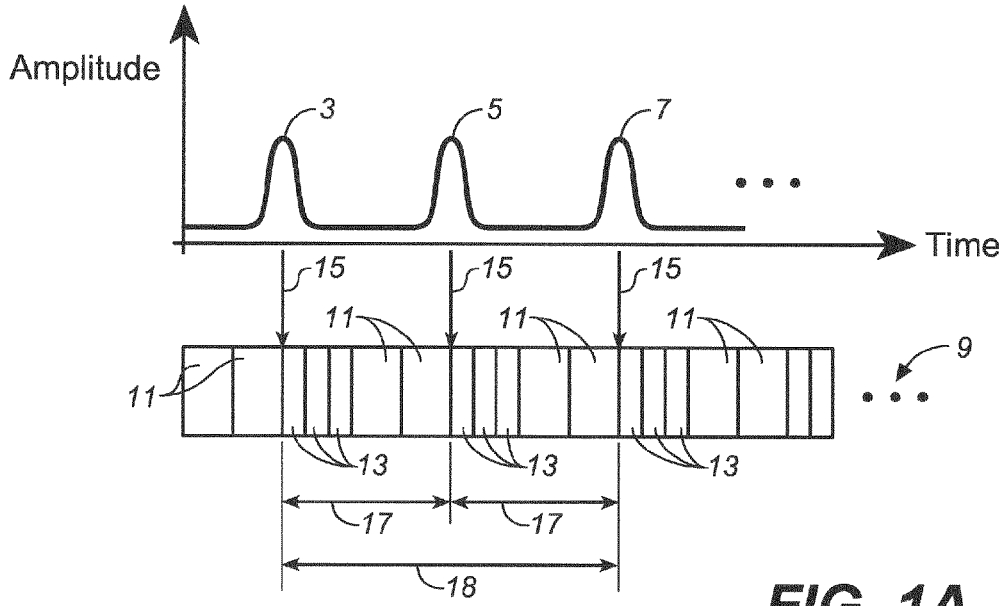
FIG. 1A illustrates estimating a tempo metric from an audio file in accordance with example embodiments of the present disclosure.

Principles of the present disclosure will now be described with reference to various example embodiments illustrated in the drawings. It should be appreciated that depiction of these embodiments is only to enable those skilled in the art to better understand and further implement the present disclosure, not intended for limiting the scope of the present disclosure in any manner.

As already mentioned, an important musical feature for various music information retrieval (MIR) applications includes a musical tempo. It is common to characterize a music tempo by a notated tempo on a sheet music or a musical score in BPM (Beats Per Minute), this value often does not correspond to the perceptual tempo. For instance, if a group of listeners (including skilled musicians) is asked to annotate the tempo of music excerpts, they typically give different answers, for example they typically tap at different metrical levels. For some excerpts of music the perceived tempo is less ambiguous and all the listeners typically tap at the same metrical level, but for other excerpts of music the tempo can be ambiguous and different listeners identify different tempos. In other words, perceptual experiments have shown that the perceived tempo may differ from the notated tempo. A piece of music can feel faster or slower than its notated tempo in that the dominant perceived pulse can be a metrical level higher or lower than the notated tempo. In view of the fact that MIR applications should preferably take into account the tempo most likely to be perceived by a user, an automatic tempo extractor should predict the most perceptually salient tempo of an audio signal.

Example embodiments described herein provide for methods, techniques or algorithms for estimating a tempo metric related to an audio signal based on an encoded bit-stream representing the audio signal, wherein the bit-stream includes a plurality of audio blocks. The method includes, receiving the bit-stream, detecting transitions in block sizes of the audio blocks in the bit-stream, determining at least one periodicity related to a re-occurrence of the detected transitions and determining an estimated tempo metric based on the determined periodicity. Such a method has many advantages, for example it exhibits low computational complexity, for example in that it relies on detecting changes in audio block sizes on the audio bit-stream.

A fundamental concept in tempo estimation algorithm is the notion of onsets. Onsets are the locations in time where significant rhythmic events such as pitched notes or transient percussion events take place. Tempo estimators in accordance with example embodiments disclosed here use a continuous representation of onsets in which a "soft" onset strength value is provided at a regular time locations. The resulting signal is frequently called the onset strength signal. It will be appreciated that employing "onsets" in an audio file, (e.g., drum beats), may determine the tempo that a listener perceives when listening to the audio file. Furthermore, example embodiments disclosed herein may rely upon such onsets appearing in the bit-stream domain as a change in audio block size. In an embodiment the detected transitions are transitions from long audio blocks to short audio blocks. The block size relates to an amount of bits required for representing a block of transform coefficient.

In an embodiment, the bit-stream is encoded in a format including mantissa and exponent to represent a transform coefficient, wherein the exponent relates to the number of leading zeros in a binary representation of the transform coefficient. Such a coding scheme as described here in accordance with example embodiment may be applicable to many different codecs (e.g., Dolby Digital (AC-3)).

In another aspect of a further embodiment, a cost of encoding the exponent is determined. This cost may relate to a bit-requirement at an encoder to encode a current exponent. It should be appreciate that a change of the cost may relate to a transition in the block sizes.

Accordingly, it will be appreciated that example embodiments disclosed herein constitutes a simple and efficient way of determining the changes in audio block size as an indirect identification of tempo information, such as the "onsets".

The cost of encoding the exponent in accordance with example embodiments herein may for example, be determined depending on an exponent strategy per audio block, as employed at an encoder end. An exponent strategy may be used to optimize bit allocation when encoding a signal. Therefore, the encoding cost calculation can be made more accurate when taking into consideration the exponent strategy as used by an encoder when generating the bit-stream.

In one aspect of the example embodiments, the exponent strategy may for example, depend on signal conditions of the audio signal. In another example embodiment, the exponent strategy may for example, include any of frequency exponent sharing, time exponent sharing and recurring transmission/encoding of exponents.

It will be appreciated by those skilled in the art that the above described strategies will contribute to optimize the before-mentioned bit allocation when encoding the audio signal, for example, by sharing one exponent among at least two mantissas, or encoding the exponents in a first audio block and reusing the exponents as exponents encoded for subsequent audio blocks, or distributing the exponents among a first audio block and one or more subsequent audio blocks.

As previously mentioned—it will be appreciated that a first increase of the cost of encoding that the exponent is likely to represent a first onset included in the audio signal. Accordingly, with a second increase of the cost of encoding; the exponent is thus likely to represent a second onset included in the audio signal.

In one example embodiment, the at least one periodicity is determined from the first and second onsets.

Example embodiments described herein may for example be employed in an audio file (e.g. music file), where the detection of first and second onsets is likely to represent a repetitive pattern from which a tempo metric may be derived.

In an another example embodiment, at least one further increase of the cost is determined, where the further increase of cost represents a further onset, and wherein at least one further periodicity is determined from at least two of the first, second and further onsets.

It will be appreciated by those skilled in the art that the estimated tempo metric will be the more accurate when more onsets are considered to derive the tempo metric. For example, a musical beat might include some "faster" and some "slower" onsets, such as drum beats. Only considering the slower drum beats could reveal a tempo metric being too low (e.g., half, quarter), and considering only the faster drum beats could result in an estimated tempo being too high (e.g. double, triple, quadruple and the like). Accordingly, a refined periodicity may be determined for example, from any of the first and further periodicities. The estimated (and more refined) tempo metric may then be based on the refined periodicity.

In yet another example embodiment, the encoded bit-stream may also include a number of encoded channels which include a number of individual channels and at least one coupling channel, and the cost of encoding the exponents for the number of channels is determined by calculating a sum of cost of encoding spectral envelopes of the individual channels and the at least one coupling channel.

In yet another example embodiment there is disclosed a method for estimating a tempo metric related to an audio signal based on an encoded bit-stream representing the audio signal, the bit-stream encoded in a format including mantissas and exponents to represent transform coefficients. Such a method may include receiving the bit-stream, repeatedly determining a cost of encoding the exponents based on information included in metadata of the bit-stream, detecting a change of the cost, determining at least one periodicity related to a re-occurrence of the detected change of cost and determining an estimated tempo metric based on the determined periodicity.

It will be appreciated that that when we have a change of the cost it will reflect the tempo a listener perceives when listening, because onsets included in the audio file are likely to have caused the change in cost at the encoder end.

In yet another embodiment, the information included in the metadata is related to an exponent strategy previously employed by an encoder end to allocate bits to the encoding of the exponents.

In another example embodiment, depending on the exponent strategy employed, a different amount of bits are allocated to exponents during encoding. In such an example embodiment, the cost of encoding the exponents may be determined based on the exponent strategy per audio block.

In one aspect, the exponent strategy may also depend on, for example, the signal conditions of the audio signal. In another aspect, the exponent strategy may for example, include any of frequency exponent sharing, time exponent sharing and recurring transmission and/or encoding of exponents.

It will be appreciated by those skilled in the art that the above described strategies may contribute to optimize the before-mentioned bit allocation when encoding the audio signal, for example, by sharing one exponent among at least two mantissas, or encoding the exponents in a first audio block and reusing the exponents as exponents encoded for subsequent audio blocks, or distributing the exponents among a first audio block and one or more subsequent audio blocks.

As previously mentioned it will be appreciated that a first increase of the cost of encoding the exponent is likely to represent a first onset included in the audio signal. Accordingly, with a second increase of the cost of encoding, the exponent may likely represent a second onset included in the audio signal.

In one example embodiment, the at least one periodicity is determined from the first and second onsets.

In yet another embodiment, at least one further increase of the cost is determined, said further increase of cost representing a further onset, and wherein at least one further periodicity is determined from at least two of said first, second and further onsets.

Therefore, a refined periodicity can thus be determined e.g. from any of the first and further periodicities. The estimated (and more refined) tempo metric can then be based on said refined periodicity.

In another embodiment, the encoded bit-stream may also include a number of encoded channels which include a number of individual channels and at least one coupling channel. The cost of encoding the exponents for the number of channels is determined by calculating a sum of cost of encoding spectral envelopes of the individual channels and the at least one coupling channel.

FIG. 1A illustrates estimating a tempo metric from an audio file in accordance with example embodiments of the present disclosure.

As shown in FIG. 1A, an audio file (e.g., a music file) includes three onsets 3, 5, 7 which may for example be characteristic of drum beats, spaced apart at a time distance. The audio file is encoded into a coded bit-stream 9 including long audio blocks 11 and short audio blocks 13.

As shown in FIG. 1A, the occurrence of the onsets 3, 5, 7 t results in transitions 15 in the audio block sizes (long 11 to short blocks 13)—as a consequence of a change in encoding strategy. Consequently, the onsets 3, 5, 7 can be detected by the detection of a change in audio block size in the coded bit-stream 9. As shown in the example embodiment in FIG. 1A, an onset 3, 5, 7 may cause a transition 15 from long to short audio block size. As used throughout this disclosure, the block size is the amount of bits that is required for representing a block of transform coefficients.

The size of the audio blocks 11, 13 reveals a downmix representation of coded audio in the bit-stream domain. It will be appreciated to those skilled in the art that audio blocks containing signals with a high bit demand may be weighted more heavily than others in the distribution of the available bits (e.g., bit pool) for one frame.

Coded bit streams 9 may, for example, include quantized frequency coefficients (e.g. MDCT coefficients).

The coefficients may, for example, be delivered in floating-point format, whereby each can include an exponent and a mantissa. See also FIG. 2. The exponents from one audio block provide an estimate of the overall spectral content as a function of frequency. This representation is often referred to as a spectral envelope. The bit allocation during encoding of the exponents can be dependent on a change in spectral content.

When the onsets 3, 5, 7 occur, a change in cost (i.e. change in bit allocation) can be observed when encoding the exponents of the bit-stream. The encoding of the exponents depends on a specific exponent strategy for the current audio block. When the onsets 3, 5, 7 occur, a change in exponent strategy for the subsequent block can be employed.

A distance determined between at least two of the onsets 3, 5, 7 is representative for a periodicity 17, 18 (e.g. repeatedly recurring drum beats) related to a tempo metric of the audio file content (specifically music). The periodicity can e.g. be a time between two onsets 3, 5, 7. Such time can be derived from further properties of the encoded bit-stream, e.g. the sample rate used when encoding.

A tempo estimation can then be derived based on said at least one of periodicities 17, 18.

E.g., if two onsets are spaced apart by 0.25 seconds, we assume a recurrence after another 0.25 seconds—thus arriving at a periodicity of 0.25 seconds.

This e.g. corresponds to a frequency of 4 Hz—indicating a tempo of 4 beats per second.

A further refinement in determining the tempo estimation can be based on considering at least two (or more) of the periodicities 17, 18, e.g. by combining and weighting them—and/or by omitting one or more of them in the estimation calculation. Such refinement steps are suitable to correct the tempo estimate for half-time, double-time or other "octave" errors.

Figure 1B:
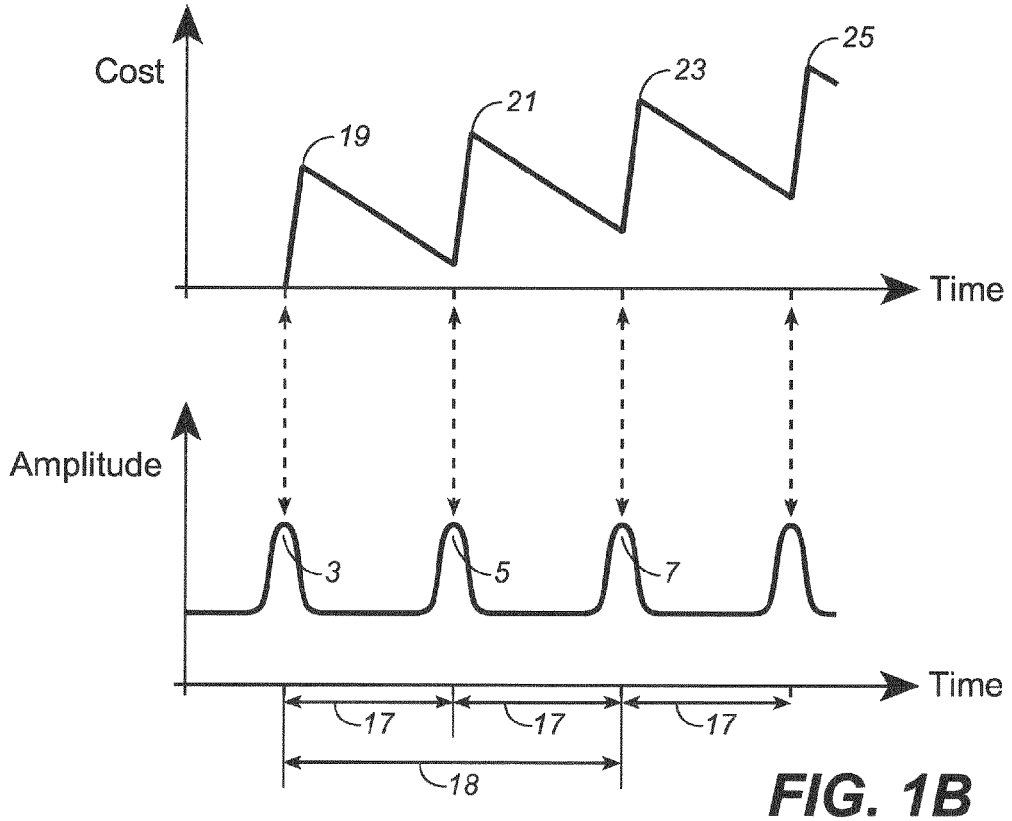
FIG. 1B illustrates a further schematic sketch of a further method for estimating a tempo metric related to an audio signal based on an encoded bit-stream representing the audio signal in accordance with example embodiments of the present disclosure.

FIG. 1*b* shows another schematic sketch of a further method according to the invention.

An audio file e.g. includes music which reveals onsets 3, 5, 7—such as characteristic drum beats—spaced apart at a time distance.

The inventor has detected that the occurrence of the onsets 3, 5, 7 typically leads to a change in cost 19, 21, 23, 25—as a consequence of a change in encoding strategy.

Based on information included in metadata of the bit-stream, a cost of encoding the exponents can be determined.

When the onsets 3, 5, 7 occur, a change in cost (i.e. change in bit allocation) can be observed when encoding the exponents of the bit-stream.

A distance determined between at least two of the onsets 3, 5, 7 is representative for a periodicity 17, 18 (e.g. repeatedly recurring drum beats) related to a tempo metric of the audio file content (specifically music). The periodicity can e.g. be a time between two onsets. Such time can be derived from further properties of the encoded bit-stream, e.g. the sample rate used when encoding.

A periodicity 17, 18 is determined that relates to the re-occurrence of the detected change of cost.

A tempo estimation can then be derived based on said at least one of periodicities 17, 18.

E.g., if two onsets are spaced apart by 0.25 seconds, we assume a recurrence after another 0.25 seconds—thus arriving at a periodicity of 0.25 seconds.

This e.g. corresponds to a frequency of 4 Hz—which is 4 beats per second.

A further refinement in determining the tempo estimation can be based on considering at least two (or more) of the periodicities 17, 18, e.g. by combining and weighting them and/or by omitting one or more of them in the estimation calculation. Such refinement steps are suitable to correct the tempo estimate for half-time, double-time or other "octave" errors.

A first increase of the cost 19, 21, 23, 25 of encoding the exponent can represent a first onset included in the audio signal and a second increase of the cost 19, 21, 23, 25 of encoding the exponent can represent a second onset included in the audio signal. At least one periodicity 17, 18 is determined from the first and second onsets. One further increase of said cost can then be determined, where said further increase of cost represents a further onset 3, 5, 7. At least one further periodicity can be determined from at least two of said first, second and further onsets.

Figure 2:
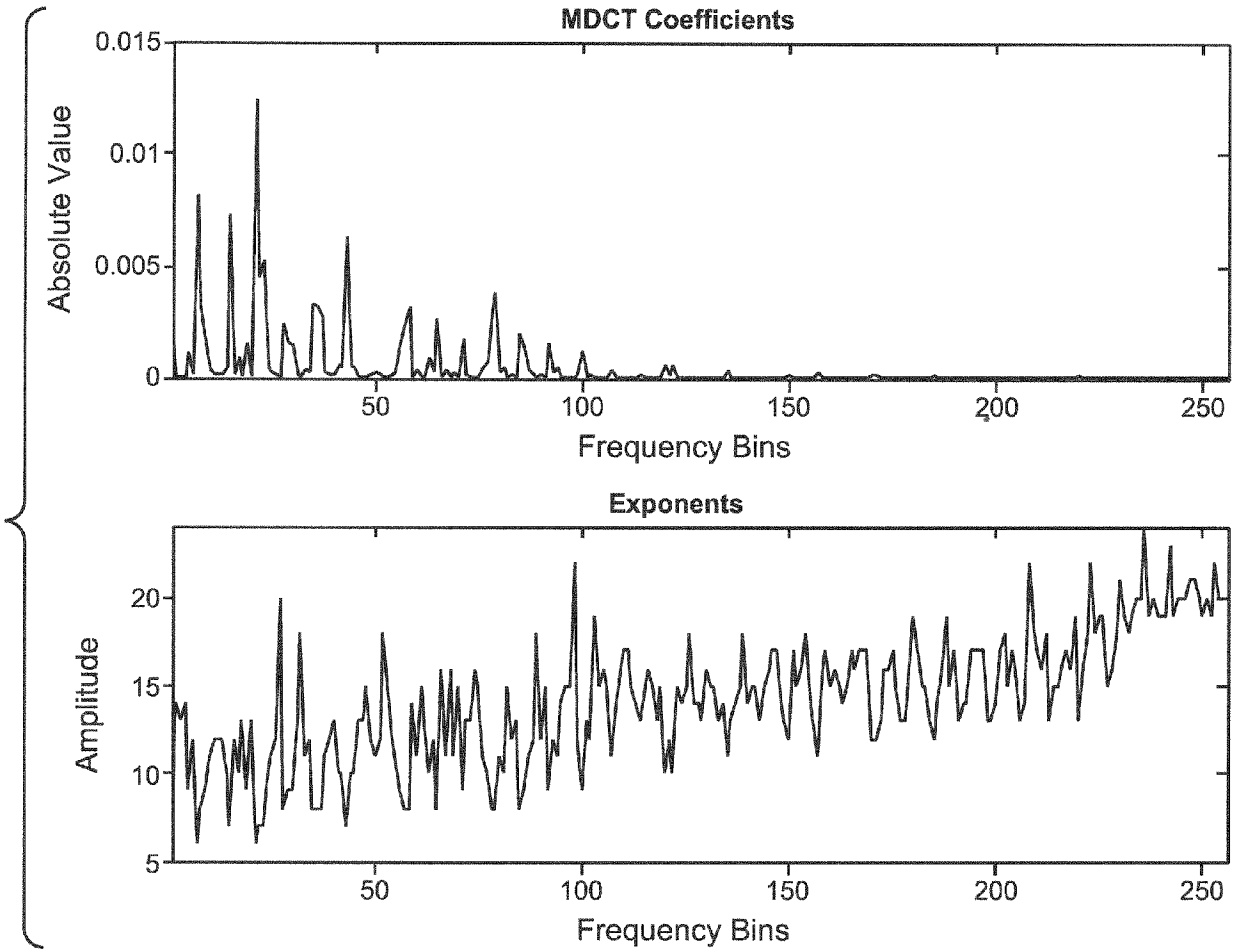
FIG. 2 illustrates graphs of modified discrete cosine transform (MDCT) coefficients and exponents in an audio bit-stream in accordance with example embodiments of the present disclosure.

FIG. 2 shows graphs of MDCT coefficients and exponents in an audio bit-stream. An absolute value respectively an amplitude of the exponent of the MDCT coefficients are shown over e.g. 250 frequency bins (dividing the frequency range into 250 sub-ranges).

The exponent relates to the number of leading zeros in a binary representation of the transform coefficient. For background information see the following reference by Davidson, G. A "Digital Audio Coding: Dolby AC-3" Digital Signal Processing Handbook, Ed Vijaj K Madisetti and Douglas B. Williams, Boca Raton CRC Press LLC, 1999.

Figure 3:
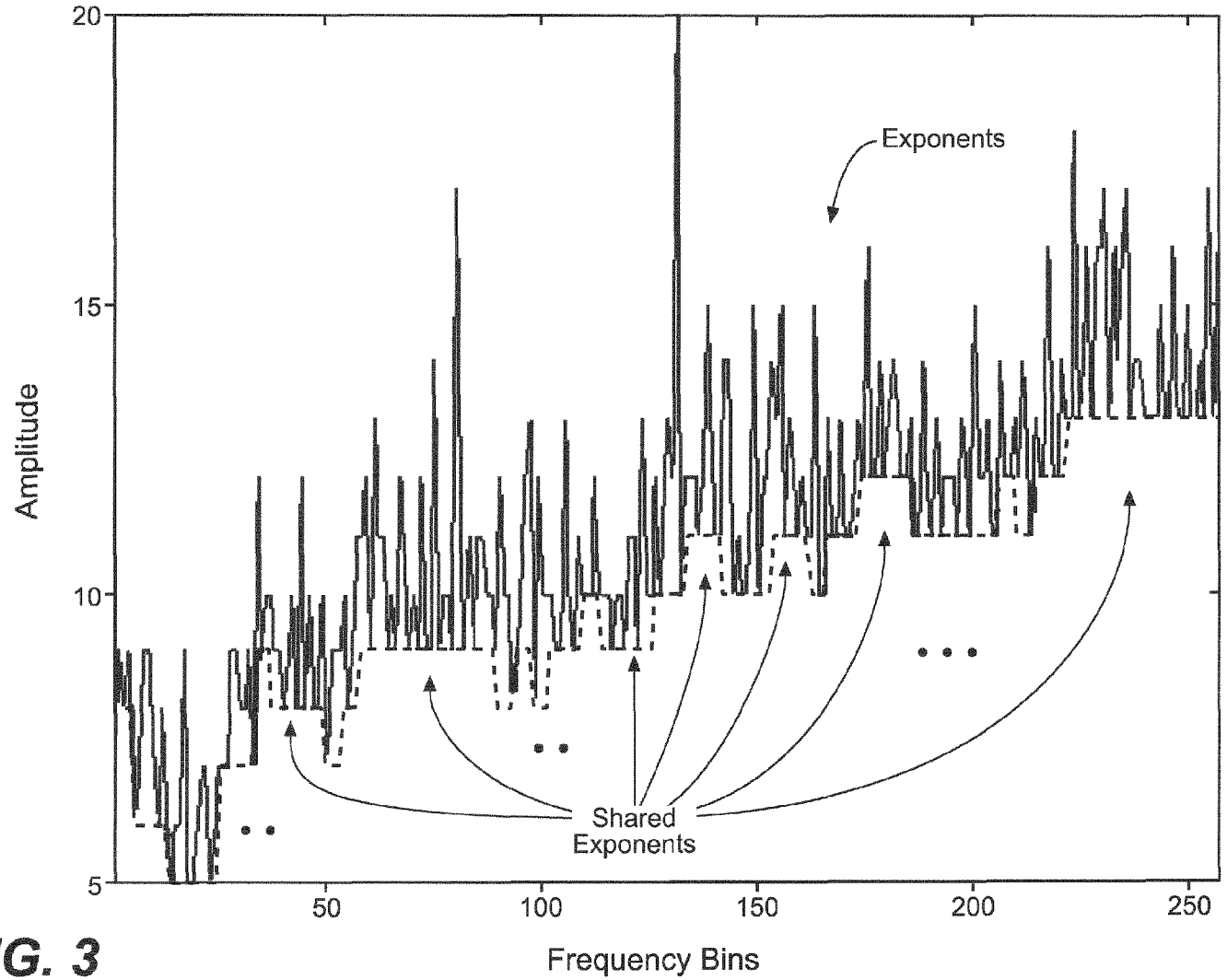
FIG. 3 illustrates an example of sharing exponents over frequency (e.g., over a pitch pipe signal which is a stationary signal) in accordance with example embodiments of the present disclosure.

FIG. 3 shows an example of sharing exponents over frequency. The example in FIG. 3 depicts a pitch pipe signal which can be regarded as a stationary signal.

Sharing exponents in either the time or frequency domain, or both, can reduce the total cost of exponent encoding for one or more frames. Employing exponent sharing therefore allows for more bits for mantissa quantization. If exponents would routinely be encoded without employing such (or other) sharing strategies, fewer bits would be available for mantissa quantization. Furthermore, the block positions at which exponents are re-encoded can significantly determine the effectiveness of mantissa assignments among the various audio blocks. Generally, an exponent sharing strategy is suitable for optimizing the bit allocation between the mantissas and exponents for encoding, by providing as many bits for quantizing/encoding the mantissas as possible—to improve the overall coding accuracy.

In the frequency domain: an exponent can be shared among at least two mantissas.

In the time domain, any two or more consecutive audio blocks from one frame can share a common set of exponents. "Re-using" the same exponent by at least two mantissas will usually lower the cost of the exponent encoding. Hence, e.g. depending on signal conditions describing if the signal is more of a stationary or not stationary signal, the encoder can decide if and when to use frequency or time exponent sharing, and when to re-encode exponents. This decision making process is often referred to as exponent strategy.

For stationary signals the signal spectrum remains substantially invariant from block-to-block.

Dolby Digital (abbreviated as AC-3), e.g., employs exponent strategies related to 6 audio blocks. When we have e.g. stationary signals, the encoder encodes exponents once in audio block zero (AB0), and then re-uses them for audio blocks AB1-AB5. The resulting bit allocation would generally be identical for all six blocks, which is appropriate for stationary signals.

For non-stationary signals, the signal spectrum can change significantly from block-to-block. The encoder can e.g. encode exponents once in AB0 and re-encode new exponents in one or more other blocks as well, thus increasing cost of encoding the exponents. Re-encoding of new exponents produces a time curve of coded spectral envelopes that better matches dynamics of the original signal.

In e.g. AC-3, the encoder encodes exponents in AB0. The current frame may e.g. be re-using exponents from the last block of the previous frame. The block(s) at which bit assignment updates occur, is governed by several parameters, but primarily by the exponent strategy—as reflected in the respective metadata field. Bit allocation updates are triggered if the state of any one or more strategy flags is D15, D25, or D45.

A flag indicating exponent strategy D15 can e.g. indicate that one exponent is "shared" by only one mantissa. D25 means e.g. that one exponent is shared by two mantissas. D45 e.g. means that one exponent is shared by 4 mantissas. An unshared exponent requires e.g. 5 bits.

Updates of bit allocations indicate onsets of the signal. If a new strategy flag is detected, a new bit allocation is about to be employed and it can indicate the occurrence of an onset in the signal if it is also related to an increase in cost of encoding the exponents.

In a multi-channel scenario, the bit-stream can include a number of encoded channels comprising a number of individual channels and at least one coupling channel.

Here, the frequency coefficients of a coupling channel can be encoded instead of encoding individual channel spectra of the individual channels—while adding side information to enable later decoding.

The cost of encoding the exponents in said multichannel scenario can then be calculated as a sum of cost of encoding the spectral envelopes of the individual channels and the at least one coupling channel.

Figure 4A:
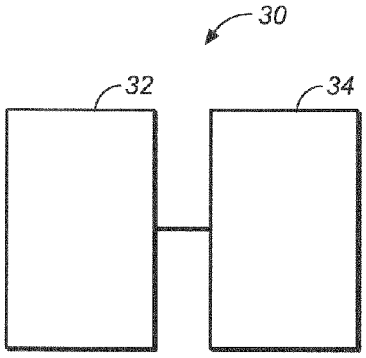
FIG. 4A illustrates a simplified block diagram of an apparatus for estimating a tempo metric related to an audio signal based on an encoded bit-stream representing the audio signal in accordance with example embodiments of the present disclosure.
Figure 4B:
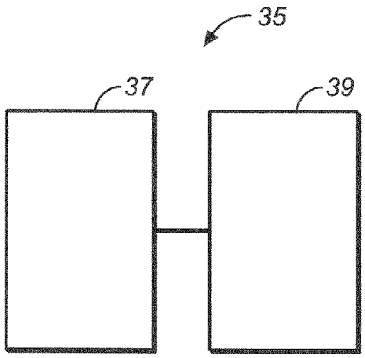
FIG. 4B illustrates a simplified block diagram of another apparatus for estimating a tempo metric related to an audio signal based on an encoded bit-stream representing the audio signal in accordance with example embodiments of the present disclosure.

FIGS. 4*a* and 4*b* each exhibit an apparatus according to the invention.

Apparatus 30 of FIG. 4*a* comprises an input unit 32 and a computing unit 34.

The functionality of the apparatus 30 incorporates functionality as depicted in and described for FIG. 1*a*.

Apparatus 35 of FIG. 4*b* comprises an input unit 37 and a computing unit 39.

The functionality of the apparatus 35 incorporates functionality as depicted in and described for FIG. 1*b*.

Figure 5:
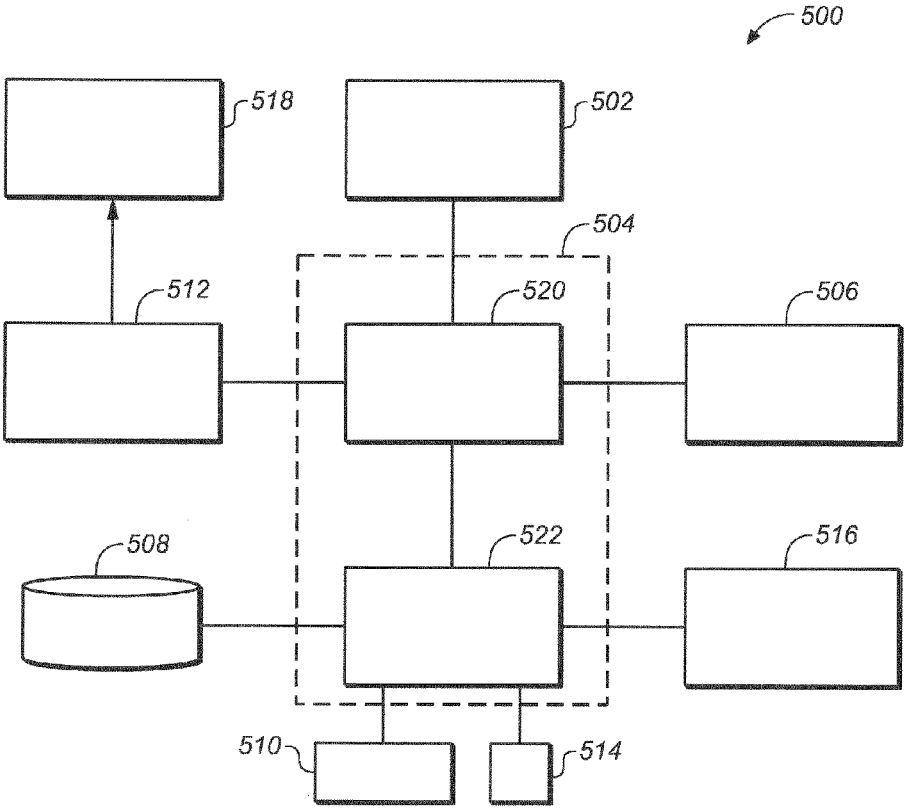
FIG. 5 illustrates a simplified block diagram of an example computer system suitable for implementing example embodiments of the present disclosure. Throughout the drawings, the same or corresponding reference symbols refer to the same or corresponding parts.

The entities shown in FIGS. 1-4 are implemented using one or more computers. FIG. 5 is a high-level block diagram illustrating an example computer 500. The computer 500 includes at least one processor 502 coupled to a chipset 504. The chipset 504 includes a memory controller hub 520 and an input/output (I/O) controller hub 522. A memory 506 and a graphics adapter 512 are coupled to the memory controller hub 520, and a display 518 is coupled to the graphics adapter 512. A storage device 508, keyboard 510, pointing device 514, and network adapter 516 are coupled to the I/O controller hub 522. Other embodiments of the computer 500 have different architectures.

The storage device 508 is a non-transitory computer-readable storage medium such as a hard drive, compact disk read-only memory (CD-ROM), DVD, or a solid-state memory device. The memory 506 holds instructions and data used by the processor 502. The pointing device 514 is a mouse, track ball, or other type of pointing device, and is used in combination with the keyboard 510 to input data into the computer system 500. The graphics adapter 512 displays images and other information on the display 518. The network adapter 516 couples the computer system 500 to one or more computer networks.

The computer 500 is adapted to execute computer program modules for providing functionality described herein. As used herein, the term "module" refers to computer program logic used to provide the specified functionality. Thus, a module can be implemented in hardware, firmware, and/or software. In one embodiment, program modules are stored on the storage device 508, loaded into the memory 506, and executed by the processor 502.

The types of computers 500 used by the entities of FIGS. 1-4 can vary depending upon the embodiment and the processing power required by the entity. The computers 500 can lack some of the components described above, such as keyboards 510, graphics adapters 512, and displays 518.

Example embodiments disclosed herein may for example, provide estimating tempo information directly from a bit-stream encoding audio information, (e.g., music).

Tempo information may as described in this disclosure be derived from at least one periodicity derived from a detection of at least two onsets included in the audio information.

Such onsets maybe detected by way of detecting long to short block transitions (in the bit-stream) or/and via a detection of a changing bit allocation (change of cost) regarding encoding/transmitting the exponents of transform coefficients encoded in the bit-stream.

What is claimed is:

1. A method, performed by an audio signal processing device, for estimating a tempo metric related to an audio signal based on an encoded bit-stream representing the audio signal, wherein the bit-stream includes a plurality of audio blocks, the method comprising:

receiving the bit-stream;

analyzing the bit-stream to detect transitions in block sizes of said audio blocks in the bit-stream;

determining at least one periodicity related to a re-occurrence of said detected transitions; and determining an estimated tempo metric based on the determined periodicity;

wherein one or more of receiving the bit-stream, detecting transitions, determining at least one periodicity, and determining an estimated tempo metric are implemented, at least in part, by one or more hardware elements of the audio signal processing device.

2. The method according to claim 1, wherein the detected transitions are transitions from long audio blocks to short audio blocks.

3. The method according to claim 1, wherein the block size relates to an amount of bits required for representing a block of transform coefficients.

4. The method of claim 1, wherein a change of a cost of encoding the audio signal relates to a transition in said block sizes.

5. The method of claim 4, wherein a first change of the cost of encoding the audio signal represents a first onset included in the audio signal, a second change of the cost of encoding the audio signal represents a second onset included in the audio signal, and the at least one periodicity is determined from the first and second onsets.

6. The method of claim 5, wherein at least one further change of the cost of encoding the audio signal is determined, said further change of cost representing a further onset, and wherein at least one further periodicity is determined from at least two of said first, second and further onsets.

7. The method of claim 6, wherein a refined periodicity is determined from any of the first and further periodicities.

8. The method of claim 7, wherein the estimated tempo metric is based on said refined periodicity.

9. A method, performed by an audio signal processing device, for estimating a tempo metric related to an audio signal based on an encoded bit-stream representing the audio signal, the bit-stream encoded in a format including mantissas and exponents to represent transform coefficients, the method comprising:

receiving the bit-stream, analyzing information included in metadata of the bit-stream to repeatedly determine a cost of encoding the exponents, detecting a change of said cost;

determining at least one periodicity related to a re-occurrence of said detected change of cost; and determining an estimated tempo metric based on the determined periodicity;

wherein one or more of receiving the bit-stream, repeatedly determining a cost, detecting a change of said cost, determining at least one periodicity, and determining an estimated tempo metric are implemented, at least in part, by one or more hardware elements of the audio signal processing device.

10. The method of claim 9, wherein the information included in the metadata is related to an exponent strategy previously employed by an encoder end to allocate bits to said encoding of said exponents.

11. The method of claim 10, wherein the exponent strategy includes any of frequency exponent sharing, time exponent sharing and recurring transmission and/or encoding of exponents.

12. The method of claim 9, wherein a first increase of the cost of encoding the exponent represents a first onset included in the audio signal, a second increase of the cost of encoding the exponent represents a second onset included in the audio signal, and the at least one periodicity is determined from the first and second onsets.

13. The method of claim 12, wherein at least one further increase of said cost is determined, said further increase of cost representing a further onset, and wherein at least one further periodicity is determined from at least two of said first, second and further onsets.

14. The method of claim 13, wherein a refined periodicity is determined from any of the first and further periodicities.

15. The method of claim 14, wherein the estimated tempo metric is based on said refined periodicity.

16. The method of claim 9, wherein the bit-stream includes a number of encoded channels comprising a number of individual channels and at least one coupling channel, and the cost of encoding the exponents for said number of channels is determined by calculating a sum of cost of encoding spectral envelopes of said individual channels and the at least one coupling channel.

17. An audio signal processing device for estimating a tempo metric related to an audio signal based on an encoded bit-stream representing the audio signal, wherein the bit-stream includes a plurality of audio blocks, the audio signal processing device comprising:

an input unit for receiving the bit-stream; and a computing unit for:

analyzing the bit-stream to transitions in block sizes of said audio blocks in the bit-stream, determining at least one periodicity related to a re-occurrence of said detected transitions, and determining an estimated tempo metric based on the determined periodicity;

wherein one or more of the input unit and the computing unit are implemented, at least in part, by one or more hardware elements of the audio signal processing device.

18. An audio signal processing device for estimating a tempo metric related to an audio signal based on an encoded bit-stream representing the audio signal, the bit-stream encoded in a format including mantissas and exponents to represent transform coefficients, the audio signal processing device comprising:

an input unit for receiving the bit-stream; and a computing unit for:

analyzing information included in metadata of the bit-stream to repeatedly determine a cost of encoding the exponents, detecting a change of said cost, determining at least one periodicity related to a re-occurrence of said detected change of cost, and, determining an estimated tempo metric based on the determined periodicity wherein one or more of the input unit and the computing unit are implemented, at least in part, by one or more hardware elements of the audio signal processing device.

19. A non-transitory computer-readable storage medium storing a sequence of instructions which, when executed by an audio signal processing device, cause the audio signal processing device to perform the method of claim 1.

20. A non-transitory computer-readable storage medium storing a sequence of instructions which, when executed by an audio signal processing device, cause the audio signal processing device to perform the method of claim 9.

* * * * *